US007044189B1

(12) United States Patent
Hanna

(10) Patent No.: US 7,044,189 B1
(45) Date of Patent: May 16, 2006

(54) ADJUSTABLE WINDOW AWNING ASSEMBLAGE

(76) Inventor: John E. Hanna, 21 Dorchester Dr., Northridge, CA (US) 91324

( * ) Notice: Subject to any disclaimer, the term of this patent is extended or adjusted under 35 U.S.C. 154(b) by 0 days.

(21) Appl. No.: 10/454,451

(22) Filed: Jun. 3, 2003

Related U.S. Application Data

(60) Provisional application No. 60/385,596, filed on Jun. 3, 2002.

(51) Int. Cl.
*E04F 10/06* (2006.01)

(52) U.S. Cl. ..... 160/66; 160/67; 160/265

(58) Field of Classification Search ..... 160/66, 160/67, 133, 383, 391, 392, 265, 264, 46; 135/89, 117, 89.117; 211/87.01
See application file for complete search history.

(56) References Cited

U.S. PATENT DOCUMENTS

| | | | | | |
|---|---|---|---|---|---|
| 2,314,354 | A * | 3/1943 | Jefferson | 294/82.1 |
| 2,339,239 | A * | 1/1944 | Carmichael | 2/314 |
| 4,481,682 | A * | 11/1984 | Hall | 2/326 |
| 4,834,160 | A * | 5/1989 | Becker | 160/66 |
| 5,148,849 | A * | 9/1992 | Faludy | 160/67 |
| 5,171,056 | A * | 12/1992 | Faludy et al. | 296/163 |
| 5,259,093 | A * | 11/1993 | D'Annunzio | 24/3.9 |
| 5,351,736 | A * | 10/1994 | Laffler et al. | 160/66 |
| 5,465,930 | A * | 11/1995 | Wu | 248/96 |
| 5,601,267 | A * | 2/1997 | Caine | 248/223.41 |
| 5,873,400 | A * | 2/1999 | Faller | 160/67 |
| 5,944,085 | A * | 8/1999 | Malott | 160/67 |
| 6,029,830 | A * | 2/2000 | Manookian | 211/87.01 |
| 6,050,280 | A * | 4/2000 | Jeske | 135/117 |
| 6,382,293 | B1 * | 5/2002 | Brockington et al. | 160/67 |
| 6,755,383 | B1 * | 6/2004 | Davis | 248/508 |
| 2002/0008125 | A1 * | 1/2002 | Caputi | 224/257 |
| 2003/0019588 | A1 * | 1/2003 | Schmitz | 160/66 |
| 2003/0182715 | A1 * | 10/2003 | Wallace | 2/338 |

FOREIGN PATENT DOCUMENTS

| | | | |
|---|---|---|---|
| FR | 9415356 | * 12/1994 | 160/265 X |

* cited by examiner

*Primary Examiner*—Bruce A. Lev
(74) *Attorney, Agent, or Firm*—Frank L. Zugelter

(57) ABSTRACT

An improved pull-strap assembly (20) made from webbing material (21) that forms a strap (23) the material (21) looped back on itself at its first or one end to form along the strap's length two layers of mated material (42) along which multiple openable pockets (42*s*, 44*m*) are formed and spaced from one another, the other or second end of strap (23) being looped backed on itself to form a pull loop (31). An openable pocket (44) is produced at the strap's first end and the multiple openable pockets (44*m*) are spaced therefrom along the length of strap (23). A connector (47) having a stem (48) and an enlarged head (49) at each end of stem (48) mounts in any one of the pockets (44*s*, 44*m*), with its enlarged head (49) of connector (47) abutting the edges of strap (23). In assemblage of pull-strap assembly (20) to a roller-tube assembly (30), connector (47) in a particular one of pockets (44*s*, 44*m*) is fed through a hole in a slot-and-hole arrangement (55, 52), FIGS. 5, 9, and as in FIG. 11 at (62, 61), so that pull-assembly (20) is operatively connected to roller-tube assembly (30). Assembly (20) is shifted or slid to a desired position along slot (55) in roller-tube (28) of assembly (30). The number of pockets (44*m*) provides adjustability for the length of extension of pull-strap (23) in unraveling an awning (24) from roller-tube (30), while pull-loop (31) is attached to a hook (58) on a panel in such adjusted extant.

5 Claims, 9 Drawing Sheets

ADJUSTABLE WINDOW AWNING ASSEMBLAGE

This invention is related to the disclosure of the Provisional Application, Improved Adjustable Window Awning Pull-strap Assembly, ACN 60/385,596, filed Jun. 3, 2002.

TECHNICAL FIELD

This invention is directed to a pull-strap assembly for an awning's roller-tube assembly and to its combination with the awning's roller-tube assembly as an assemblage.

BACKGROUND TO THE INVENTION

Pull-straps are used and applied to window and patio awning assemblies mounted on RV and other motor vehicles. To date, these straps have been found to deteriorate, to become discolored, or even to break. The deterioration is usually caused by exposure to ultraviolet rays of the sun and to nature's wind and other elements. Deteriorated straps, if still useable, require sewing to maintain their operational function with an awning's roller-tube assembly. With today's commercial assemblages, do-it-yourself-owners or operators of RV's or like vehicles re-sew their RV's pull-straps because of such deterioration, or because of prices, or buy and install fresh ones. A longer-life pull-strap assembly is also looked forward to in an advance of the applicable art. There is a need to remove these disadvantages to a mobile vehicle operator, as this invention does.

An advantage in this invention is the elimination of the need to remove or disassemble an end cap on some awning roller assemblies so that another pull strap can be installed in the pull-strap slot of the awning's roller-tube. In other awning roller-tube assemblies a hole is formed directly across the roller tube's slot to install the invention's pull-strap assembly to the awning's roller-tube assembly.

Another advantage in this invention is to provide for an accurate length for the pull-strap in its assemblage, between its roller-tube assembly and a fixed hooking member on a side wall panel, by the inclusion of a multiple number of pockets into one of which a connector is inserted and installed in a slot of the roller-tube assembly whereby the length of the pull-strap is adjustable to achieve such accuracy.

SUMMARY OF THE INVENTION

The subject matter of the invention is directed to a novel pull-strap assembly and in its installation to and with an awning's roller-tube assembly to produce an assemblage that is mountable upon a window panel of a motor vehicle, such as an RV vehicle, on which this kind of assemblage is already mounted, required, or desired. The pull-strap assembly includes a number of spaced pockets along the length of the assembly's strap resulting from the secured mating of portions of the strap after one of its ends has been looped back upon itself to produce two layers of the strap one abutting the other and in which a multiple number of mating portions in the two layers in turn are secured to each other. The other end of the strap is formed into a (finger) pull-loop by overlapping the end upon the strap itself and securing its two generated layers of strap together. The strap itself is made from a material in the form of a strip that is thin and strong, and long-lasting. The multiple number of pockets provides the adjustability of length for the pull-strap assembly to meet the accuracy desired in an open mode for the roller's awning. A connector, in the form of a rigid stem having enlarged heads on its opposing ends and which abut the edges of the strap, is disposed within an end pocket or one of the multiple spaced pockets, their heads, after installation of the pull-strap assembly to an awning's hollow roller-tube, seating against the body formation forming the roller-tube's slot. The heads are of a larger size than that of the slot. With the connector installed in one of the multiple pockets any remaining pocket of the strap in the direction of the strap opposite to its pull-loop end is bent back upon itself prior to introducing and installing the connector and strap to the slot. In effecting such installation, the connector in its pocket is fed through a hole in the awning's roller-tube and which hole communicates with the slot in the awning's roller-tube, so that the pull-strap assembly in its introducing step can be operatively connected to the awning's roller-tube. The pull-strap assembly is then slid along the slot to a desired position in the slot whereby its (finger) pull-loop is attachable to a hook securely mounted below a window to the panel of the motor vehicle upon opening-up of the awning. The number of pockets provide for adjusting the length of the pull-strap of its assembly to accurately meet the panel hook, the variation in the distance between the pull-strap and such hook being a disadvantage in present day assemblages. Each pocket's opening is of an expandable nature, found in the material of the strap itself, to introduce a head of the connector so that it can project out of the other edge of the pocket. In the assembling of the pull-strap to the roller-tube of the awning, the one of the multiple number of pockets' opening is pinched against the stem of the connector due to the folds in the bent-backed condition of the pocket upon itself at the location of the connector, which in turn frictionally assists in retaining the connector of the pull-strap assembly in its seat behind its slot. The slot is formed by a cavity in the roller-tube and through which slot the pull-strap itself exits from the awning's roller-tube.

An object of this invention is to provide a novel pull-strap assembly for a roller-tube of an awning.

Another object of the invention is to provide a novel and improved assemblage of an awning roller assembly and a pull-strap assembly for it.

Yet another object of the invention is to provide adjustability in the length of the pull-strap assembly, thus providing for its accurate length to a vehicle's panel hook to which it is fastened.

A further object of the invention is to eliminate the appearance of markings and attendant noise accompanying it on a motor vehicle's panel by the fluttering of the pull-loop of the strap assembly against the vehicle's panel.

A still further object of the invention is to provide ease of installation of the pull-strap assembly to its awning's roller-tube assembly.

Yet another object of the invention is to eliminate disassembly of a part of an awning's roller-tube assembly to install the pull-strap assembly.

Still another object of the invention is to produce a pull-strap assembly having a longer life span than prior art pull-straps, and which is less affected by ultra-violet rays of the sun or inclement weather elements such as rain, ice, wind, and the like.

Again another object of this invention is to reduce costs in the installation of a pull-strap assembly.

These and other objects and advantages of the invention will become more apparent by a full and complete reading of the following description, its appended claims, and the accompanying drawing comprising nine (9) sheets of fifteen (15) FIGURES.

BEST MODE FOR CARRYING OUT THE INVENTION

Figure 2:
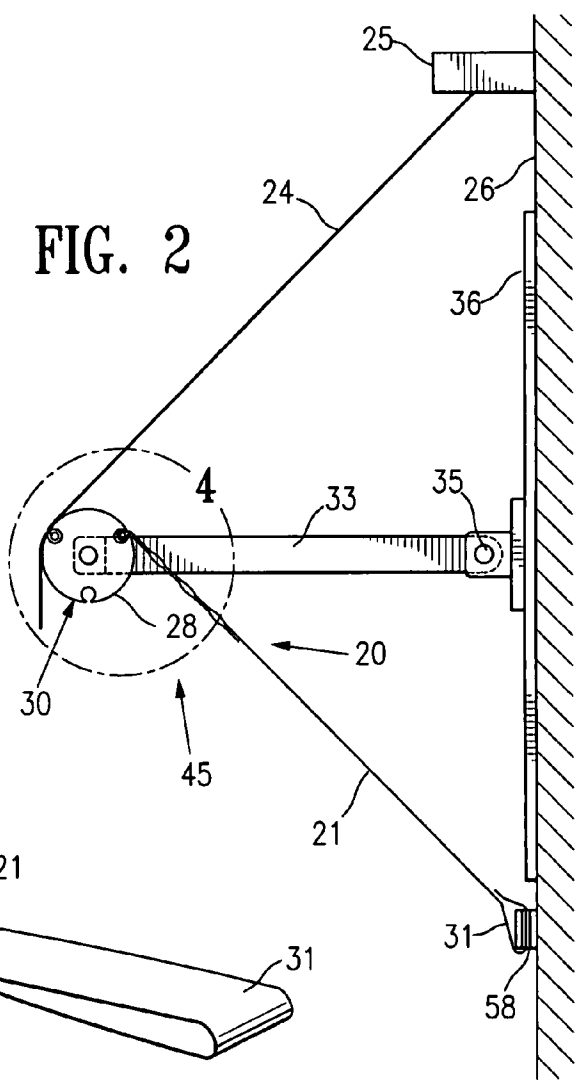
FIG. 2 is a view taken on line 2—2 of FIG. 1.
Figure 1:
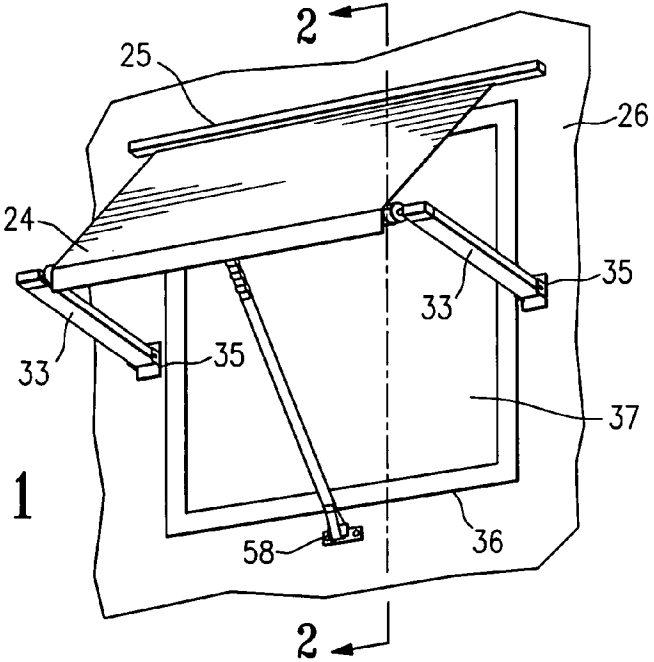
FIG. 1 is a perspective view expressing the operativeness of the assemblage of the assemblies of this invention.
Figure 3:
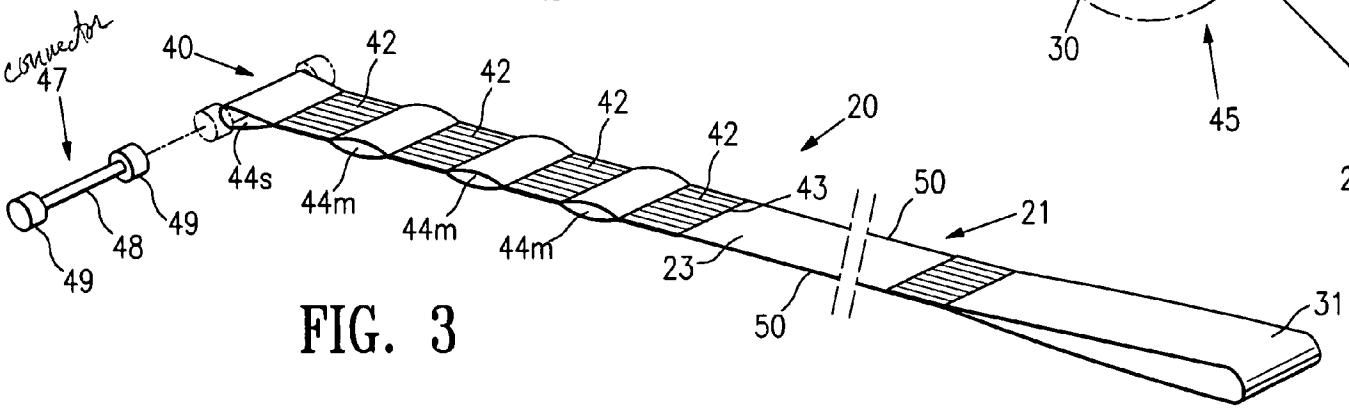
FIG. 3 is a perspective view of a pull-strap assembly of this invention, with its connector shown removed while shown in phantom in the strap's one end openable pocket when installed in the pull-strap assembly.
Figure 4:
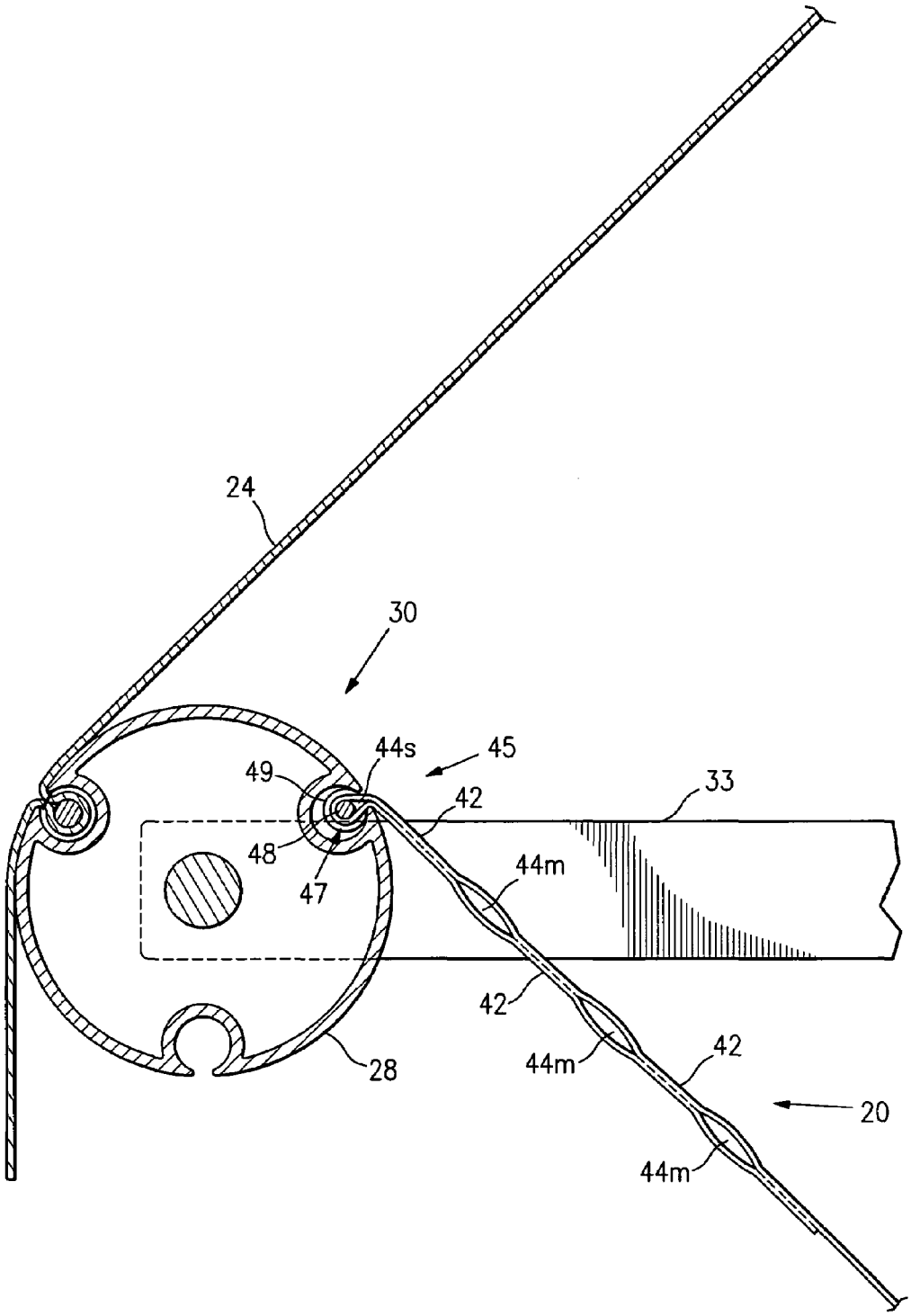
FIG. 4 is an enlarged diagrammatic elevational view within circle 4 of FIG. 2, of the assembling of the pull-strap assembly to its awning's roller-tube assembly, the strap's one end openable pocket being assembled to the roller-tube assembly in this view.

Turning now to the drawing wherein reference characters refer to like numerals hereinafter, FIG. 3 illustrates a pull-strap assembly 20 formed of a thin webbing material 21 forming a strap 23 of pull-strap assembly 20. Strap 23 approximates, for example, one inch in width and of a length suitable for wrapping about and along with an awning 24, FIGS. 1, 2, having its one end customarily secured to its awning rail 25, FIG. 1, suitably secured to a side wall panel 26 of a motor home or the like, such as a recreational vehicle [RV] while the strap's body rolls around a roller-tube 28 in its assembly 30 so that in the awning's closed mode, a pull-loop 31, FIG. 3, customarily formed at the one end of strap 23, remains exposed beyond the rolled-up condition for awning 24 in its closed mode about roller-tube 28. Its closed mode is provided in an abutting relationship to the vehicle's side wall panel 26 by means of a pair of arms 33 (customarily) spring-biased towards panel 26. The awning's roller-tube 28 rotates in a customary manner as the latter moves back and forth between the closed and open modes for awning 24. Arms 33 are pivotally mounted as at 35, FIGS. 1, 2, to panel 26 along the opposite vertical sides of a window frame 36 its window 37 being shaded by awning 24 in it open mode. In the formation of pull-strap assembly 20, FIG. 3, at its end 40 opposite its pull-loop 31, strap 23 is looped back over and upon itself a substantial way along its length, to provide two (2) contiguous layers of material 21. A multiple number of spaced mated areas 42 are permanently fixed together along a length of strap 23 between the assembly's end 40 and a terminal end 43, FIG. 3, of strap 23. In turn, the spaced mated areas 42 form a multiple number of spaced openable pockets, a one openable pocket 44*s* at end 40 resulting from the looping back of strap 23 on itself and a multiple number of openable pockets 44*m* past pocket 44*s* along the length of strap 23 extending in the direction towards the terminal end 43 of strap 23. The multiple number of pockets 44*m* provides adjustability in the length of pull-strap assembly 20 in an operational mode for an assemblage 45 of the invention.

Figure 5:
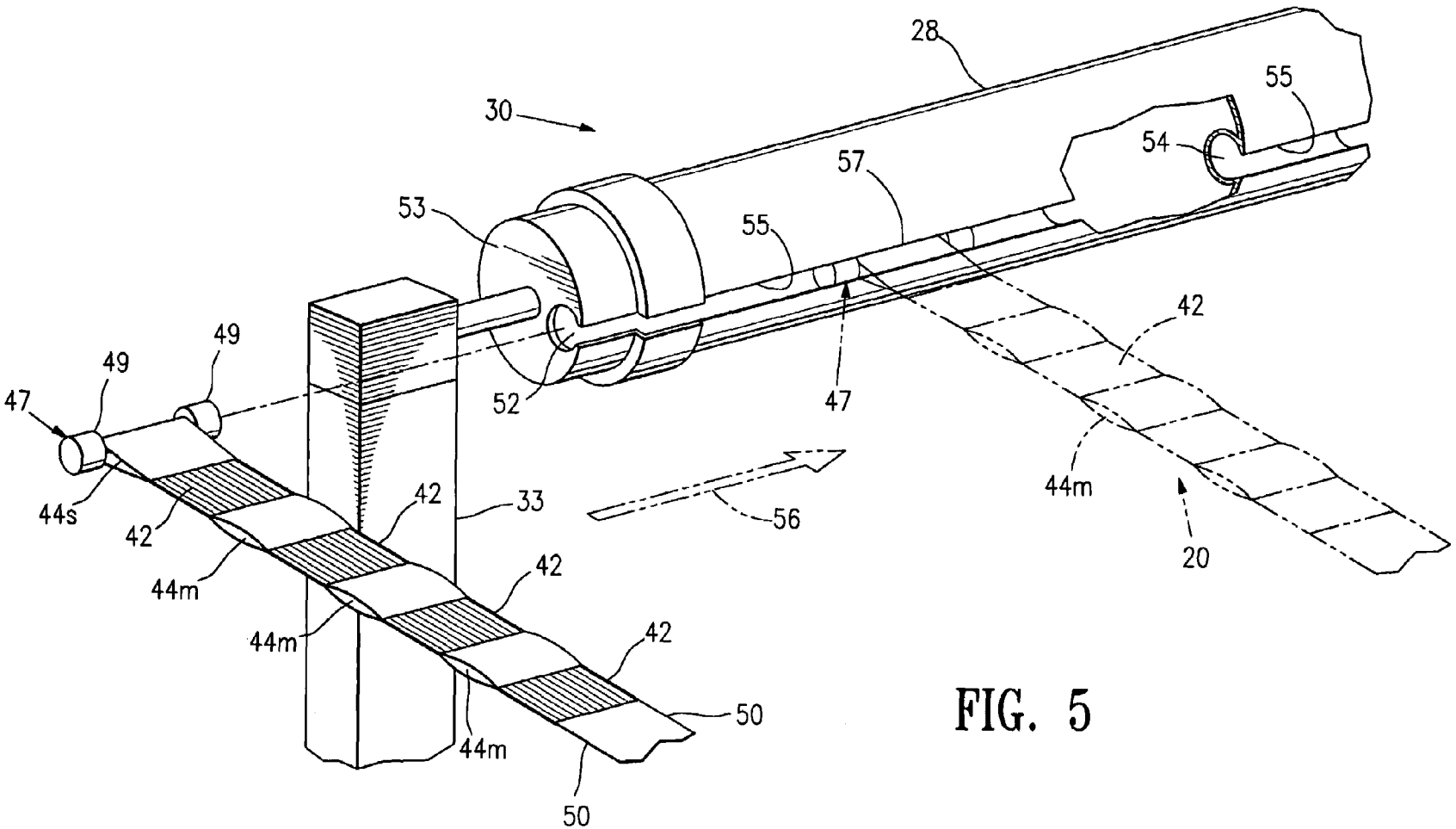
FIG. 5 is a perspective diagrammatic view, partially broken away, of an initial step of connecting the strap's one end openable pocket of the pull-strap assembly to its awning's roller-tube assembly that has its slot communicating with a hole in an end cap of the roller-tube assembly.
Figure 8:
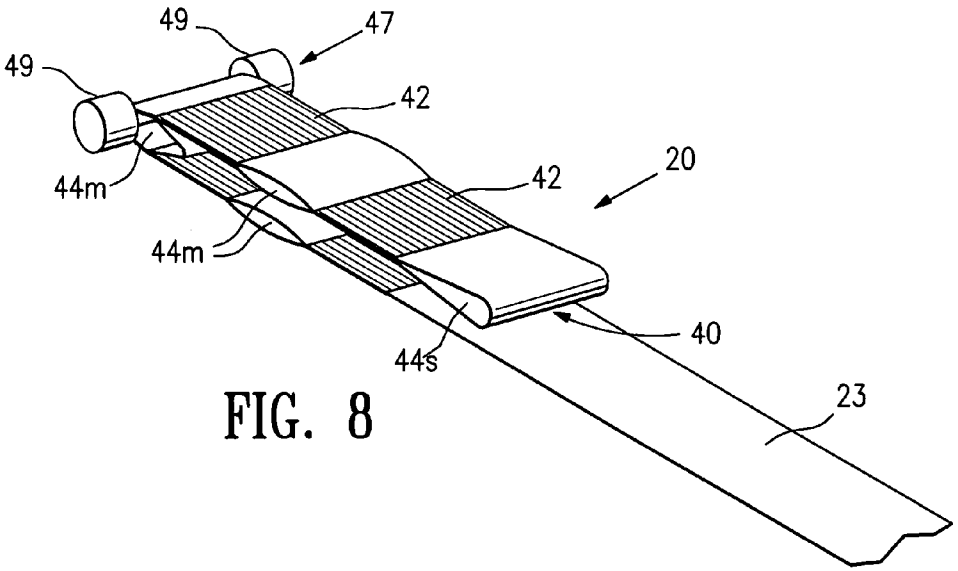
FIGS. 6, 7, and 8 are perspective diagrammatic views, respectively, of inserting a connector of the pull-strap assembly into one of its multiple number of openable pockets other than the strap's end openable pocket, FIG. 6, after which the remaining ones of the number of pockets in the direction of the strap's end openable pocket are laid upon or over the strap proper as illustrated in FIG. 8, FIG. 7 illustrating in a cross-sectional manner formation of the folds of the connector's pocket in preparation of installing the connector and its pull-strap assembly to a roller-tube assembly.
Figure 7:
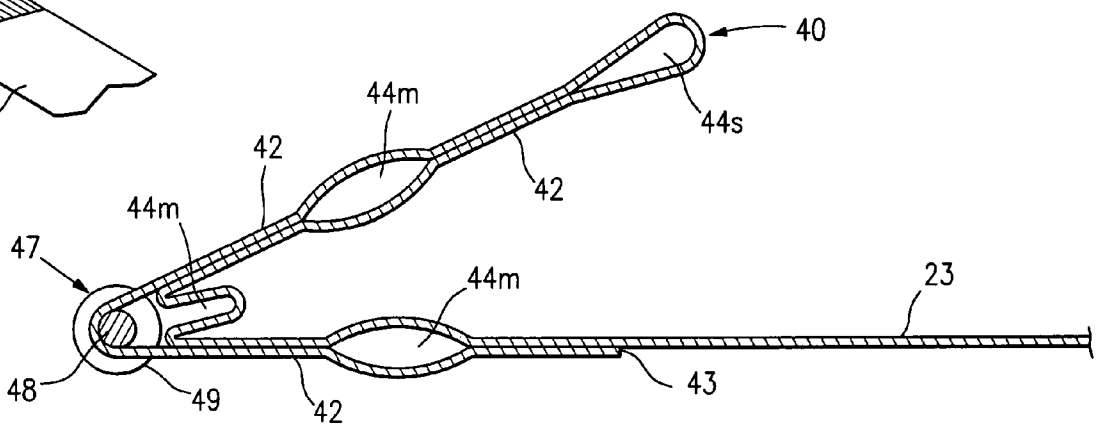
Figure 6:
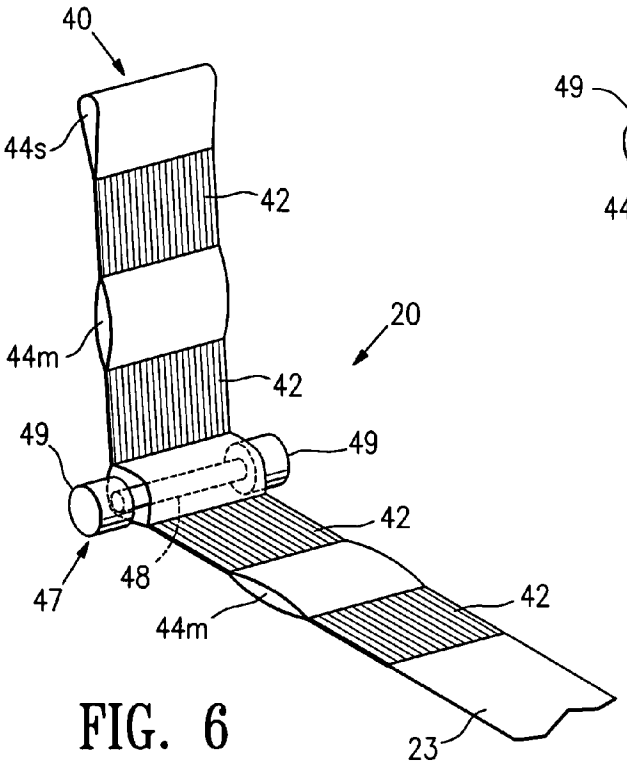

A connector 47 is formed from a rigid member for disposal or insertion within either the end openable pocket 44*s* or within any one of the multiple number of pockets 44*m*. Connector 47 includes a stem 48 at each end of which a head 49 of a larger dimension than stem 48 is secured or formed thereon but not of a diameter larger than that of each openable pocket 44*s*, 44*m* in the latters' most expanded states in order to install its two (2) heads 49 adjacent to and exterior of the strap's longitudinal edges 50. A single connector 47 is inserted within a single pocket 44*s* or within one of the multiple pockets 44*m*, for operational mode of use, by expanding from a flattened or slimmed-down condition for strap 23 an expanded opening of pocket 44*s* or an expanded opening of one of the multiple number of pockets 44*m*, and by which a head 49 at one end of stem 48 is inserted into one of such pockets to pass through it so as to position itself in its final disposition along and exterior of its corresponding and other edge 50 of strap 23. FIG. 5 illustrates connector 47 in end pocket 44*s* and FIGS. 6, 7, and 8 illustrate connector 47 in one of the multiple pockets 44*m* of its assembly 20. It is clear from FIGS. 5, 6, 7, and 8 the manner in which connector 47 is inserted into either pocket 44*s* or a pocket 44*m*, namely, by a manual insertion of a head 49 through an expanded opening of pocket 44*s* or one of pockets 44*m*, and that stem 48 sets within the width of strap 23 and the heads 49 seat adjacent to their corresponding edges 50 of strap 23.

Figure 9:
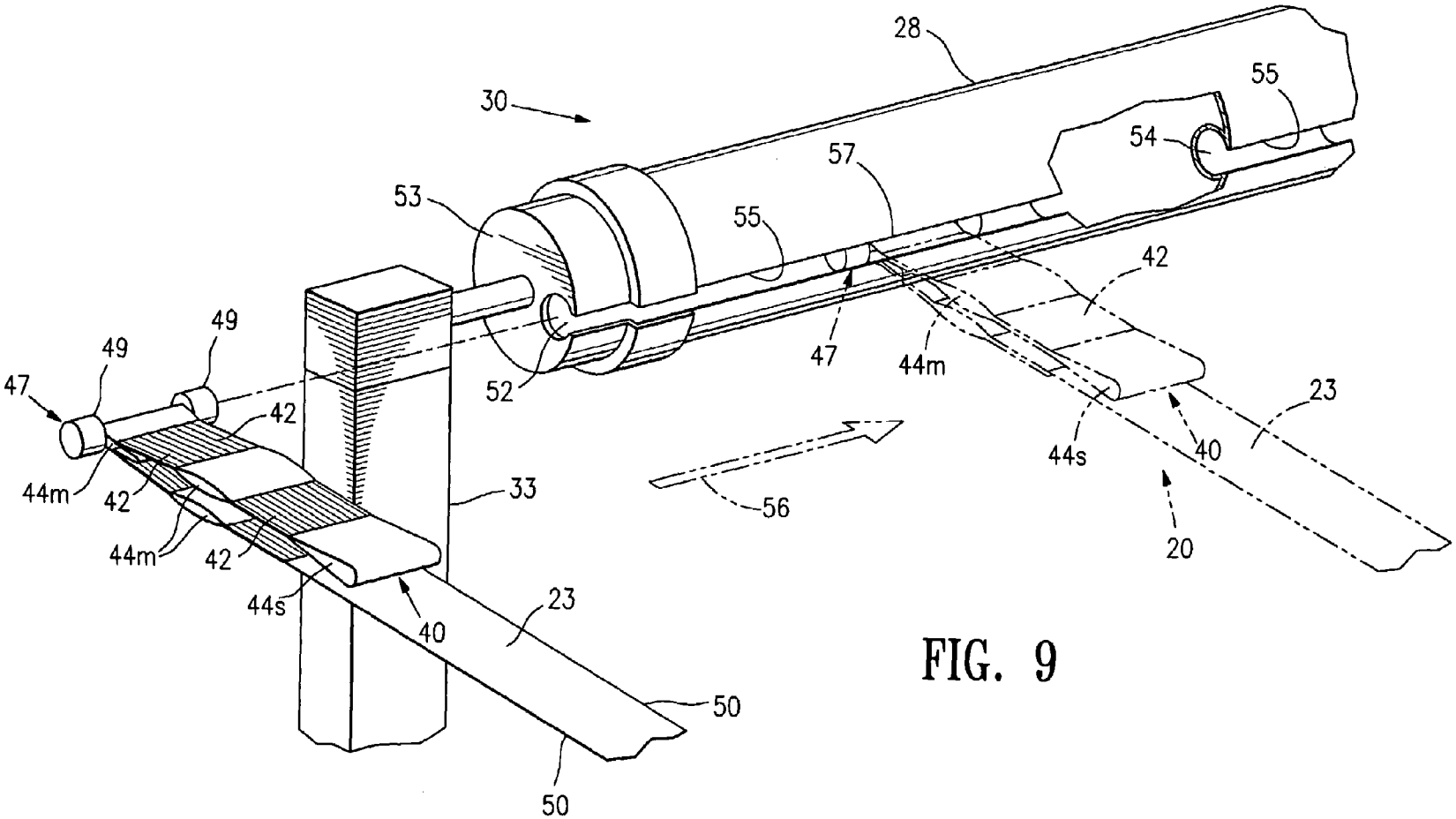
FIG. 9 is a perspective diagrammatic view like that of FIG. 5, however, a connector inserted in one of the multiple number of pockets other than the strap's end openable pocket is being installed in the roller-tube's assembly.
Figure 11:
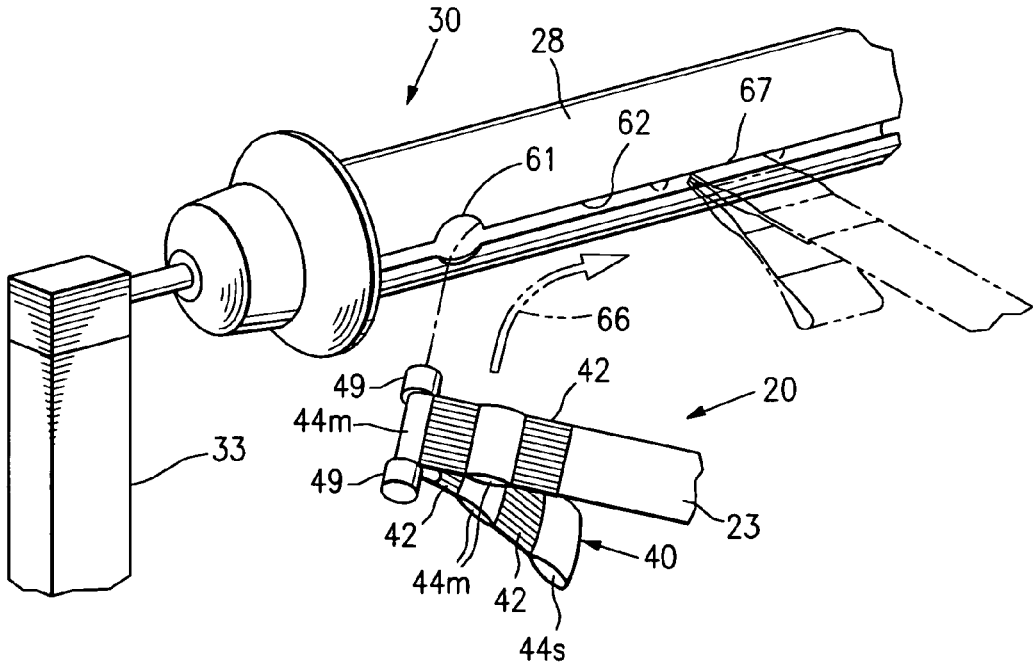
Figure 12:
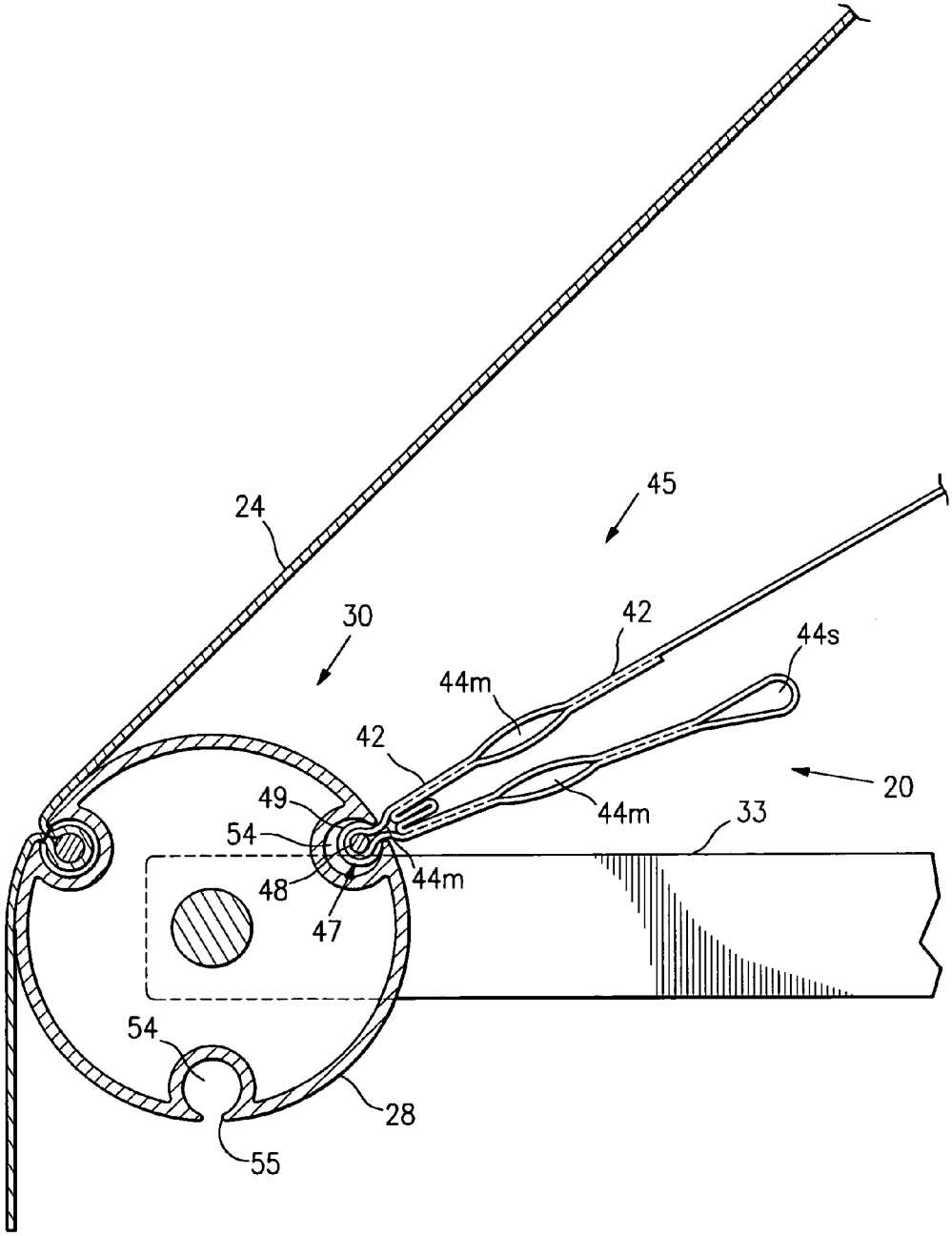
FIG. 12 is a diagrammatic cross-sectional view of the manner by which a connector mounted in one of a number of multiple openable pockets of the pull-strap assembly is installed to a roller-tube assembly.
Figure 13:
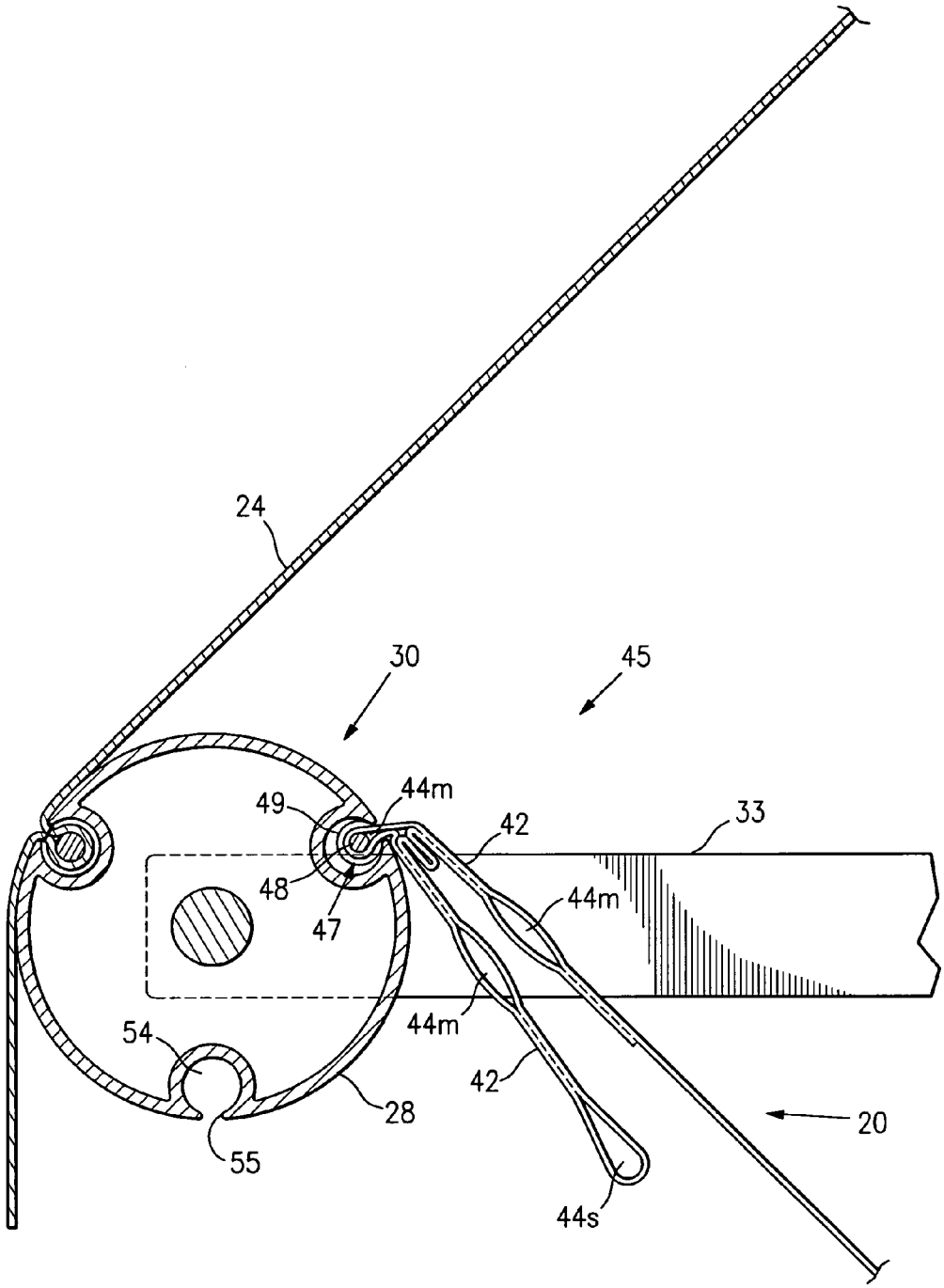
FIG. 13 is a diagrammatic cross-sectional view of the installed connector mounted in one of a number of multiple openable pockets after the strap of the pull-strap assembly has been connected to a hook member on the side wall panel of a vehicle.

Attaching pull-strap assembly 20 to an awning roller-tube assembly 30 is illustrated by FIGS. 5, 9, and 11. In the FIG. 5 and FIG. 9 assemblings, a hole-and-slot arrangement 52 is included in an end cap 53 of one conventional awning's roller-tube assembly 30. The roller-tube 28 itself is formed from a conventional hollow circular aluminum extrusion, FIGS. 12, 13 that includes cavities 54 along which slots 55 in cavities 54, FIGS. 12, 13, extend the length of its roller-tube 28. A connector 47, inserted and properly seated within its end pocket 44*s*, FIG. 5, or in one of the multiple number of pockets 44*m*, illustrated in FIG. 9, is installed through the hole of arrangement 52 and then slid along its slot 55 in roller-tube 28 in a direction shown by arrow 56, FIGS. 5, 9, to a position along slot 55 of an awning's roller-tube 28, illustrated in phantom as at 57, FIG. 5, determined by the adjusted length that is used of strap 28 by reason of the particular pocket, either pocket 44*s* or one of the pockets 44*m*, selected relative to the fixed location of a hook member 58, FIGS. 1, 2, secured to the vehicle's side wall panel 26 below window frame 36.

Figure 10:
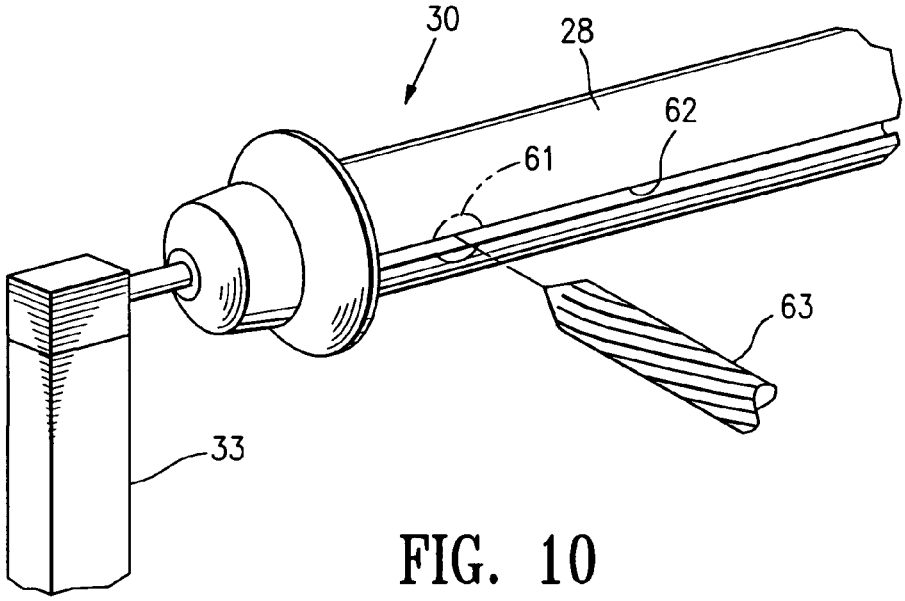
FIGS. 10 and 11 are perspective diagrammatic views of preparation of a roller-tube assembly that has no end-cap slot through which a connector can be installed, FIG. 10, FIG. 11 illustrating the manner by which the connector is installed in the slot of the roller-tube assembly.

In the FIG. 11 assembling, a hole 61 is either already drilled across a slot 62 in the roller-tube 28 of another conventional awning's roller-tube assembly 30, or is easily formed in roller-tube 28 by operation of a (hand) drill 63, FIG. 10. Hole 61 provides for the introduction of a connector 47, already inserted and seated in one of the multiple number of pockets 44*m*, or seated in the single pocket 44*s* illustrated in FIG. 5, of a pull-strap assembly 20, into slot 62, FIG. 12, in roller-tube 28 in a direction shown by arrow 66, to a position shown in phantom at 67 in the awning's roller-tube 28 along its length, again determined by the adjusted length that is used of strap 28 by reason of the particular pocket, either pocket 44*s* or one of the pockets 44*m*, selected relative to the fixed location of a hook member 58, FIGS. 1, 2, secured to the vehicle's side wall panel 26 below window frame 36.

Figure 15:
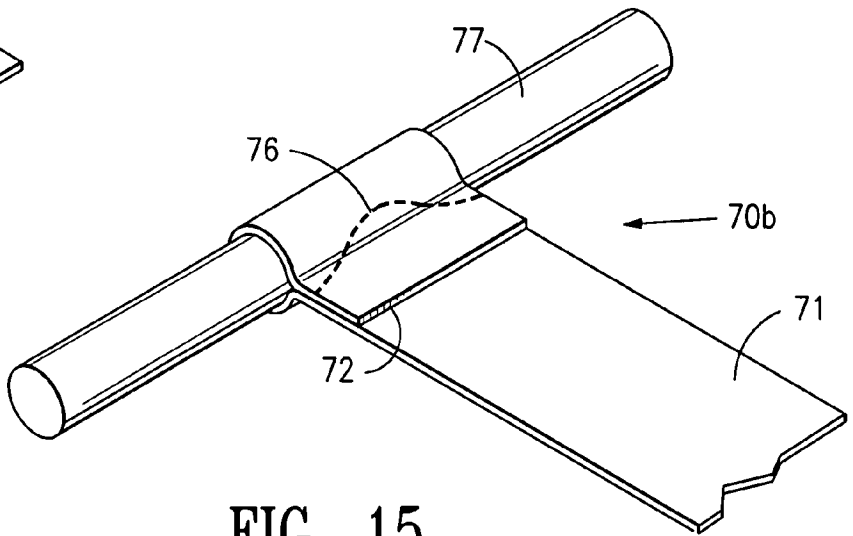
FIG. 15 PRIOR ART
FIGS. 14 and 15 are Prior Art illustrations of old-style connectors that are found in today's marketplace for motor vehicle roller-tube and pull-strap assemblages.
Figure 14:
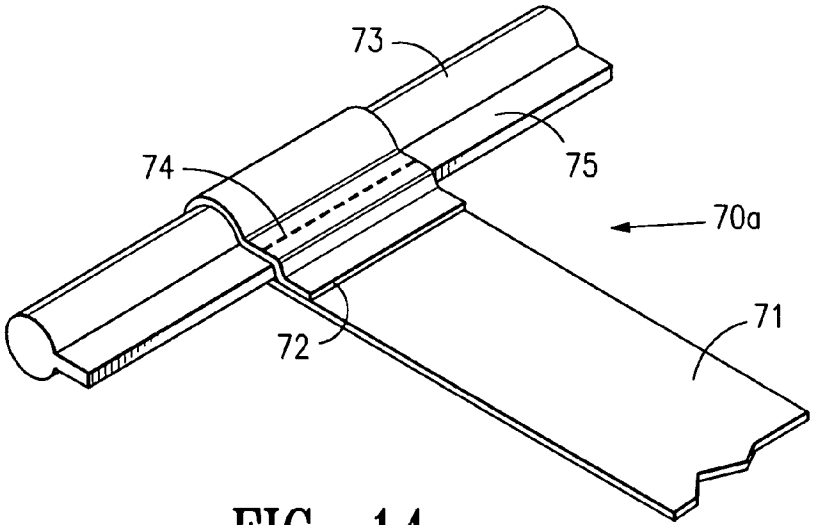
FIG. 14 PRIOR ART

FIGS. 14 and 15 illustrate prior art attaching devices 70*a* and 70*b*, respectively, by which a pull-strap 71 is connected to an awning's roller-tube. One end 72 of a customary fabric strap 71, FIG. 14, is wrapped around a rubber bar 73 and then sewn across the width of strap 71 by a stitch 74 to a lip 75 on bar 73, or as illustrated in FIG. 15, wherein a sewn stitch 76 across the width of strap 71 is woven along a line through its rubber bar 77 as well as through the width of strap 71 itself. In either instance, past use of these devices has shown that they are not long-lasting, deteriorate over time under nature's elements, and disassemble themselves by reason of the stitches 74, 76 wearing out causing strap 71 and its deteriorating rubber bars 73, 77 to dis-associate from one another, in which case strap 71 exits from a roller-tube's slot. Further, only one length of strap 71 is available between its assembly to a roller tube and a hook on a vehicle's side wall panel, requiring the need to seek a particular lengthened strap assembly required for the particular awning and vehicle to which it is to be applied. In this invention, with the availability of a multiple number of pockets 44*m* in but one pull-strap assembly 20, the assembly 20 is useful to numbers of kinds of motor vehicles and awnings. In addition, the rigidity of connector 47 and choice of strong and thin webbing material 21 provide a less deteriorating condition for pull-strap assembly 20.

In operation of the subject matter of the invention, upon pull-loop 31 being attached to hook member 58, the tautness of strap 23 in the open mode for awning 24 provides for a slimness of pockets 44*s*, 44*m*, and particularly with respect to the pocket in which connector 47 that seats behind slot 55. The pocket is not in its expandable state and the size of slot 55 is such that the pinching of the pocket about stem 48 of connector 47 at slot 55 frictionally assists maintaining connector 47 in its stationary position within slot 55.

It should be apparent that the purpose of the multiple number of pockets 44*m* in the invention is to provide a ready adjustment of the length of a pull-strap assembly that can be utilized with a variety of awning apparata that include rolled-up awnings, to provide an accurate reaching to a hook member of a side wall panel in the open mode for the awning.

In further carrying out the best mode for the invention the webbing material 21 is formed from thin Nylon™ stock, approximating one (1") in width, its mated secured-together areas 42 approximating ½-inch in length. Connector 47 is machined from stainless steel stock, with its stem 48 approximating 0.096 inch in diameter and its heads 49 of a diameter approximating 0.220 inch. Brass, aluminum and other suitable materials also may be utilized for connector 47 as well as other suitable fabrics which are strong and thin being suitable in place of Nylon™ for the webbing material 21. The technique of permanently fixing together the two layers of material 21 to form the spaced mated areas 42 is carried out by machinery manufactured by Branson Ultrasonics Corporation, San Dimas Calif. 91773 which an ultra-sonic welding of mated areas 42 takes place.

Various modifications and changes may be made without departing from the scope of the appended claims. The application of the invention is not limited to merely RV window panels, but also applicable to side panels where, for example, a shady location only is desired. Connector 47 can be formed by threaded heads thereon or as presently done its stem being machined from a rod of a head's diameter.

INDUSTRIAL APPLICABILITY

The invention is most useful in the mobile home and RV industries for installation of pull-strap assemblies to awning assemblies, however, its utility is useful on hollow tubes and walls in other arts as well.

I claim:

1. The combination of a roller-tube in an assembly having a slot formed in the body formation of the roller-tube and a pull-strap assembly connected to said roller-tube through said slot and by which an element within said roller-tube is opened-up through said slot by operation of said pull-strap assembly, said pull-strap assembly comprising a pull-strap of a length formed of a thin composite of two layers of strong and thin material, said length extending from a looped-back end of the strong and thin material forming the pull-strap to a terminal end for the pull-strap, said layers including longitudinal edges formed along said length of said pull-strap, said two layers permanently mated to each other along the length of said pull-strap, a plurality of spaced pockets formed in said permanently mated two layers along the length of said pull-strap and openable to said longitudinal edges, and connecting means removably mountable in any one of said plurality of spaced pockets installed to said slot of said roller-tube, said connecting means comprising a pair of heads each of said heads seatable on the body formation behind the slot in said roller-tube, and a stem of a size less than the sizes of said heads, said pair of heads securely mounted to said stem, said stem and pair of heads removably mountable throughout said any one of said plurality of open pockets and which is installed within said slot, each of said pair of heads on said stem extending exteriorly of and along its corresponding one of said longitudinal edges to seat on the body formation of the slot in said roller-tube.

2. In the combination of claim 1, said stem and said pair of heads are of a rigid nature.

3. In a pull-strap assembly for operation with another assembly having a body formation with a slot therein, said pull-strap assembly including a pull strap having longitudinal edges along a length of strong and thin material forming the pull-strap of said assembly, a plurality of spaced pockets formed in said length of said pull-strap and openable to both said longitudinal edges, said pull-strap assembly including connecting means having a stem and a pair of heads one on each end of said stem, said stem disposable throughout any one of said openable pockets of said pull-strap, said heads projecting from said stem exteriorly of said longitudinal edges of said pull-strap, the improvement in said connecting means comprising each of said heads being of a larger dimension in directions other than the direction of said stem, said stem of a size less than the dimensions of said heads, whereby said heads are adapted to seat upon the body formation behind the slot upon installing said pull-strap assembly to the other assembly.

4. The pull-strap assembly of claim 3 wherein said stem and said pair of heads is integrally formed and is of a rigid nature.

5. The improvement of claim 3 wherein each of said heads on each end of said stem is mounted adjacent to and not extending distantly from their corresponding longitudinal edges of said pull strap.

* * * * *